United States Patent [19]

Kajiyama

[11] 4,375,249

[45] Mar. 1, 1983

[54] FLOOR SELECTOR SYSTEM FOR ELEVATOR SYSTEM

[75] Inventor: Ryuichi Kajiyama, Inazawa, Japan

[73] Assignee: Mitsubishi Denki Kabushiki Kaisha, Tokyo, Japan

[21] Appl. No.: 200,336

[22] Filed: Oct. 24, 1980

[30] Foreign Application Priority Data

Oct. 24, 1979 [JP] Japan ..... 54-137445

[51] Int. Cl.[3] ..... B66B 3/02

[52] U.S. Cl. ..... 187/29 R

[58] Field of Search ..... 187/29; 340/19, 21

[56] References Cited

U.S. PATENT DOCUMENTS

| | | | |
|---|---|---|---|
| 2,938,603 | 5/1960 | Loughridge | 187/29 |
| 4,191,277 | 3/1980 | Meyer et al. | 187/29 |
| 4,193,478 | 3/1980 | Keller et al. | 187/29 |

FOREIGN PATENT DOCUMENTS 50-52746 5/1975 Japan .

54-146362 11/1979 Japan .

*Primary Examiner*—J. V. Truhe
*Assistant Examiner*—W. E. Duncanson, Jr.
*Attorney, Agent, or Firm*—Wenderoth, Lind & Ponack

[57] ABSTRACT

A floor selector comprises a first and a second switch on an elevator car, a vertical array of first switch actuators each disposed between each pair of adjacent floors in a hoistway, and another vertical array of second switch actuators located below the first actuators in the hoistway. When the first switch engages each of the first actuators, a synchronized floor is renewed by adding one floor to the preceding synchronized floor read out from an RAM by a micro-processor and written into the RAM. When the second switch engages each of the second actuators, an advanced floor in advance of the synchronized floor is renewed by adding two floors to the preceding advanced floor read out from the RAM by the micro-processor and written into the RAM.

2 Claims, 5 Drawing Figures

FLOOR SELECTOR SYSTEM FOR ELEVATOR SYSTEM

BACKGROUND OF THE INVENTION

This invention relates to improvements in a floor selector system for an elevator system.

In the operation of an elevator system it is indespensable to sense the position of the elevator car. This sensing is accomplished by an associated floor selector. A positional signal for the car delivered from the floor selector is used to display the position of the car on associated floors and in the car, and to determine if the car is to be stopped and so on. The floor displaying the position of the car is called hereinafter a "car floor" and the positional signal for the car is called hereinafter a "car-floor signal." There have been already employed various types of floor selectors. One of the known floor selectors has comprised an electric reversible motor, a screw rod connected to the motor to be rotated thereby, a movable nut screw threaded onto the screw rod against rotational movement, and a plurality of sets of position contacts, one for each floor of a building, selectively engageable by the movable nut during its movement along the screw rod. The floor selector has been arranged so that, during the ascent of the elevator car, for example, a car-floor signal is delivered each time the car passes through a predetermined point located above each floor. The car-floor signal is operated to rotate the motor to move upwardly the movable nut along the screw nut resulting in the closure of the position contact set corresponding to the next succeeding floor in the direction of the ascent of the elevator car. This closure of the position contact set delivers a car-floor signal which, in turn, stops the motor and also senses in synchronization with the movement of the car a synchronized floor corresponding to the now closed contact set. The process as described above is repeated to cause the movable nut to ascend stepwise with increments of one floor.

In the descent of the elevator car the movable nut is arranged to descend similarly with increments of one floor.

On the other hand, upon the start of the elevator car from each floor, an associated circuit has sensed therein an advanced car position or an advanced floor which is, for example, the next succeeding floor in the direction of travel of the car, in order to look for a call. In the presence of a call registered on that floor or a call for that floor registered on the elevator car, a command landing signal is delivered to cause the car to land at the floor where the call has been registered. Otherwise, the movable nut closes the position contact set corresponding to that floor having no call registered thereon whereupon the abovementioned advanced floor proceeds to the last-mentioned floor.

If the elevator car is suddenly stopped before it reaches that floor corresponding to the advanced car position then the synchronized floor is spaced from the advanced floor by one floor because the advanced floor is set upon the start of the elevator car. When the car is then started, the advanced floor is again set so that the synchronized floor is spaced from the new advanced floor by two floors. Under these circumstances, it is impossible to operate the elevator car smoothly.

In order to correct this spacing between the synchronized and advanced floors, the advanced floor must be returned back to the synchronized floor with a complicated circuit configuration. Furthermore, the floor selector as described above has encountered problems such as abrasion of the components involved because it relies upon mechanical operation and also increased manufacturing cost because of the use of the reversible motor which is expensive. There is therefore a demand for a floor selector which is highly reliable and economical.

Accordingly, it is an object of the present invention to provide a new and improved floor selector system for an elevator system for preventing a spacing between a synchronized floor and an associated advanced floor from changing even upon the sudden stoppage of an elevator car involved.

SUMMARY OF THE INVENTION

The present invention provides a floor selector for an elevator system having an elevator car traveling within a hoistway extending through a plurality of floors disposed at predetermined equal intervals one above another, comprising means including an electronic computer for sensing successively synchronized floors displayed in synchronization with the travel of the elevator car and advanced floors in advance of associated synchronized floors and for delivering signals for the synchronized and advanced floors wherein there are provided a first and a second switch actuator disposed between each pair of adjacent floors, first calculation means responsive to the passage of the elevator car through the first switch actuator to calculate the synchronized floor by effecting the addition or substraction of one floor to or from a synchronized floor at that time by the electronic computer, and second calculation means responsive to the start or passage of the elevator car through the second switch actuator to calculate the advanced floor by adding or subtracting a predetermined number of the floors to or from the synchronized floor by the electronic computer.

Preferably, the floor selector may comprise further means for causing the advanced floor to coincide with the with the synchronized floor upon the stoppage of the elevator car.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
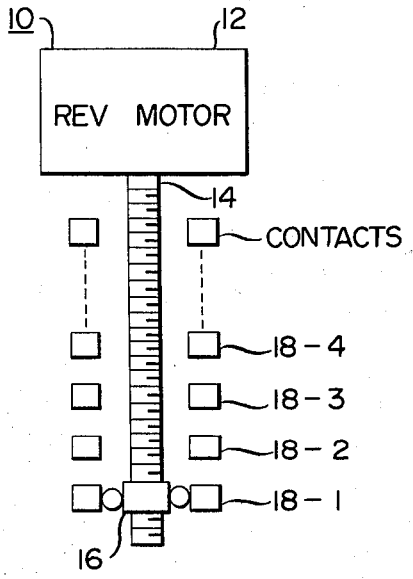
FIG. 1 PRIOR ART
FIG. 1 is a schematic front elevational view of a conventional floor selector for an elevator system.

Referring now to FIG. 1 of the drawings, there is illustrated a conventional floor selector for an elevator system. The arrangement illustrated comprises a floor selector 10 disposed within a machine compartment (not shown) including an electric reversible motor 12 for the floor selector 10, a screw rod 14 connected to the motor 12 to be rotated thereby, and a movable nut 16 screw threaded onto the screw rod 14 against rotational movement.

A plurality of sets of position contacts are disposed along the screw rod 14, one for each of the floors of a building served by an associated elevator system, although the floors of the building are not illustrated only for purposes of simplicity of illustration. The sets of position contacts are arranged to sandwich selectively the movable nut 16 therebetween to be put in their closed position and designated by the reference numeral 18 with a suffix 1, 2, 3, . . . , identifying the floors. For example, the reference numeral 18-1 designates the set of position contacts corresponding to a first one of the floors. When the nut 16 is moved along the screw rod 14 without the rotational movement of nut 16, the nut 16 successively is engaged by the sets of position contacts 18-1, 18-2, 18-3, . . . , to sense successively synchronized floors for an associated elevator car (not shown).

In FIG. 1 the position contact set 18-1 is shown as being closed through the movable nut 16. This means that the elevator car (not shown) is located on the first floor. When the elevator car travels upwardly and passes through a predetermined point above the first floor, a car-floor signal is delivered as will be described later. The motor 12 responds to that car-floor signal to be rotated thereby to move the nut 16 upwardly through the rotational movement of the screw rod 14. During this upward movement, the nut 14 engages the set of position contacts 18-2 for the second floor to operate the latter to deliver another car-floor signal. The motor 12 responds to the latter signal to be stopped and a synchronized floor is sensed by the position contact set 18-2 put in its closed position. That is, a synchronized floor is the second floor.

When the elevator car further travels upwardly and passes through a predetermined position above the second floor, the electric motor 12 is similarly rotated to move the movable nut 16 further upwardly through the rotational movement of the screw rod 14 until position contact set 18-3 is similarly operated.

In this way the movable nut 16 ascends stepwise with increments equal to one floor.

On the other hand, upon the start of the elevator car from the first floor, an associated circuit (not shown) senses thereon an advanced position of the elevator car or an advanced floor corresponding, for example, to the second floor which is in advance of the first floor by one floor. This is because a call is looked for. At that time, it is assumed that a call has been registered on the second floor. Under the assumed conditions, a command stopping or landing signal is delivered to stop the elevator car on the second floor. In the absence of a call registered on the second floor, the engagement of the movable nut 16 with the position contact set 18-2 results in the advanced floor as described above proceeding to the third floor.

The process as described above is repeated to cause the movable nut 16 to ascend stepwise with increments of one floor.

In this way the advanced floor has been set upon the start of the car. Under these circumstances, if the elevator car is suddenly stopped before the car arrives at the advanced floor then the synchronized floor is spaced from the advanced floor by one floor in the example as described above. When the elevator car is then started, the advanced floor is again set to be spaced from the synchronized floor by two floors. Under these circumstances, it is impossible to operate the elevator car smoothly.

In order to correct such a spacing between the advanced and synchronized floor, the advanced floor must be returned back to the synchronized floor which is attended with the necessity of using a complicated circuit configuration. Furthermore, the floor selector 10 has encountered problems such as abrasion of the components involved because it relies upon mechanical operations, and an increase in manufacturing cost because the reversible electric motor used is expensive. Therefore, it is desirable to provide floor selectors which are highly reliable and economical.

The present invention contemplates to comply with the demand as described in the introductory portion of the specification.

Figure 2:
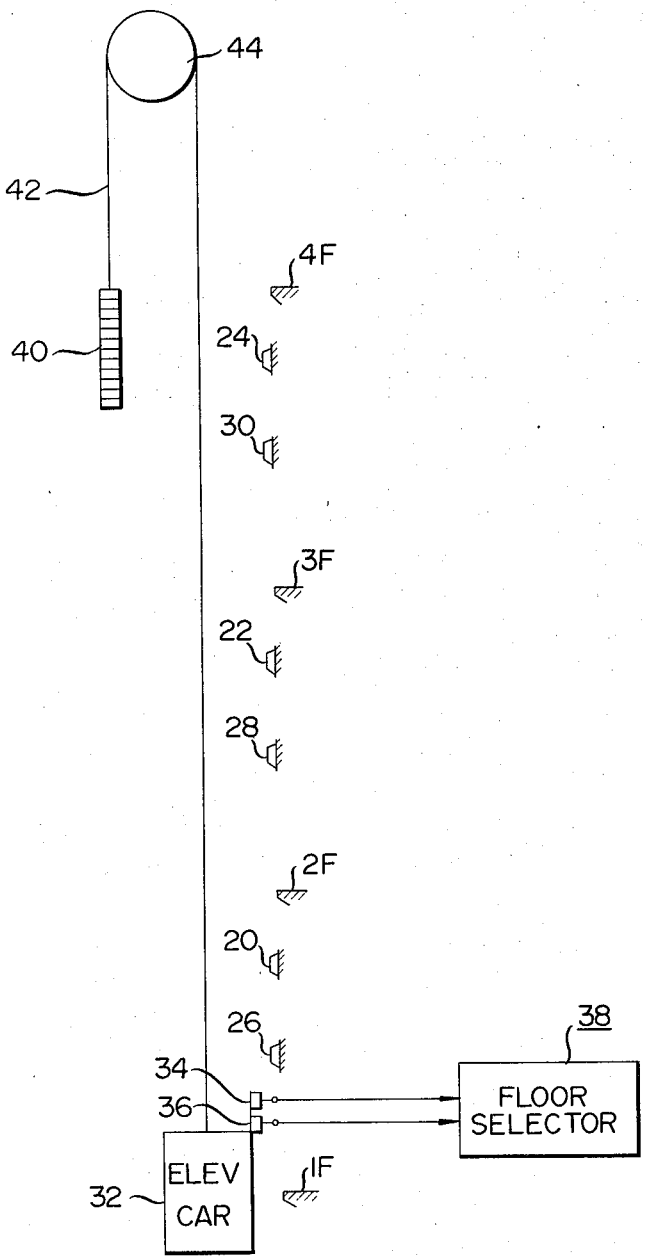
FIG. 2 is a schematic block diagram of one embodiment according to the elevator floor selector system of the present invention.

Referring now to FIG. 2, there is schematically illustrated one embodiment according to the floor selector of the present invention. The arrangement illustrated comprises a plurality of floors. In this case, a first, a second, a third and a fourth floor 1F, 2F, 3F and 4F respectively are shown as being located at predetermined equal intervals one above another with the omission of those floors disposed above the fourth floor. One array of cams or switch actuators 20, 22 and 24 are disposed at predetermined distances above the floors 1F, 2F, 3F and 4F respectively to be vertically aligned with one another and with edges of the floors. Another array of cams or switch actuators cams 26, 28 and 30 are disposed below the cams or switch activators 20, 22 and 24 respectively to be vertically aligned with one another and with the edges of the floors and spaced therefrom by predetermined equal intervals respectively. Therefore, all the switch actuators are disposed in a vertically aligned relationship in a hoistway (not shown) extending through the floors 1F, 2F, 3F and 4F. However, the array of cams or switch actuators 20, 22 and 24 are horizontally staggered from the array of switch actuators 26, 28 and 30.

The arrangement further comprises an elevator car 32 arranged to travel upwardly and downwardly within the hoistway as described above and a pair of switches 34 and 36 disposed on a vertical plate erected on the outer surface of the ceiling of the elevator car 32 adjacent to one edge thereof. The switches 34 and 36 are positioned so that, during the travel of the elevator car 32 the switch 34 engages selectively the switch actuators 20, 22 and 24 to renew the synchronized floor while the switch 36 engages selectively the switch actuators 26, 28 and 30 to renew the advanced floor. The switches 34 and 36 are electrically connected to a floor selector generally designated by the reference numeral 38.

In order to move the elevator car 32 upwardly and downwardly, the same is connected to a counterweight 40 through a traction rope 42 trained over a hoist wheel 44. The hoist wheel 44 is connected to a hoist electric reversible motor (not shown).

The floor selector 38 shown in FIG. 2 includes an electronic computer. In the example illustrated the electronic computer comprises a micro-processor commercially available as TYPE 8085 from the Intel Corporation for example. However, it is to be understood that the micro-processor 38 is not limited thereby or thereto and may comprise any suitable digital computer which is commercially available.

Figure 3:
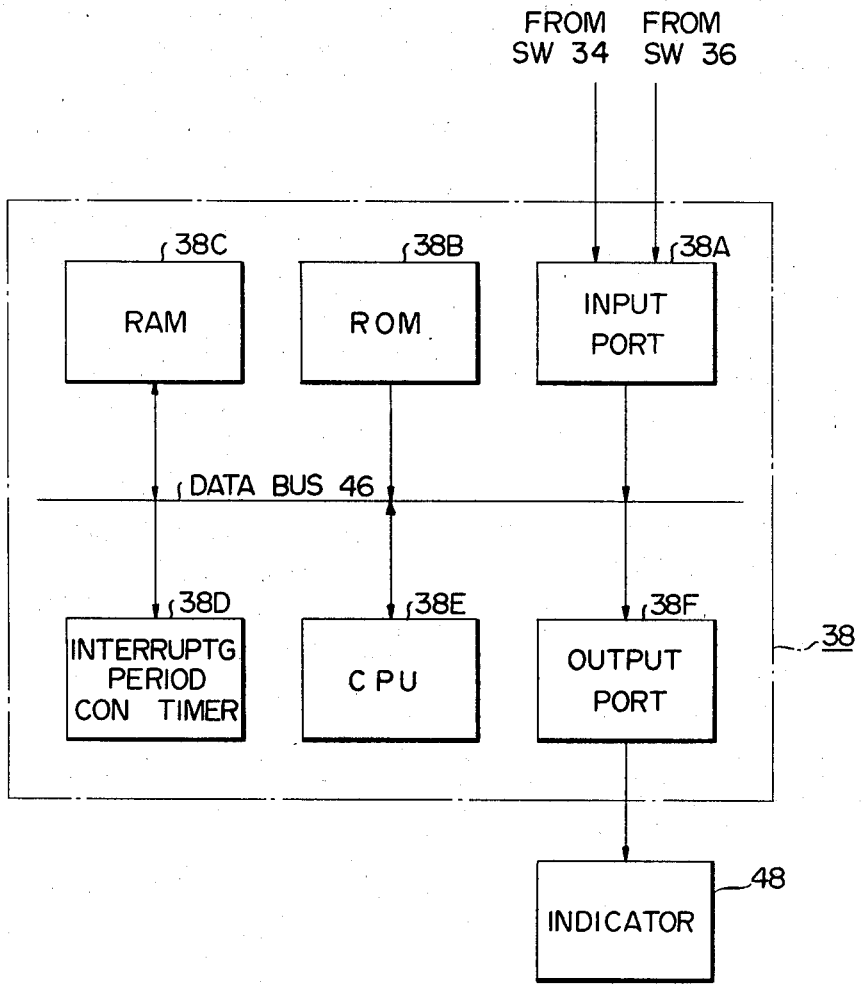
FIG. 3 is a block diagram of the floor selector shown in FIG. 2 and composed of a micro-processor.

The micro-processor includes (as shown in FIG. 3) an input port 38A which is connected to the switches 34 and 36 and which is also connected to a data bus 46; the data bus 46 is also connected to a read only memory device (which is abbreviated hereinafter to "ROM") 38B, a random access memory device (which is abbreviated hereinafter to "RAM") 38C, an interrupting period control timer 38D, a central processor 38E and an output port 38F. The input port 38A and the ROM 38B are arranged to supply data to the data bus 46 while the timer 38D and the output port 38F are arranged to receive data from the data bus 46. The RAM 38C and central processor 38E are arranged to supply data to and receive data from the data bus 46.

In the example illustrated, the input port 38A, the ROM 38B, the RAM 38C, the timer 38D, the central processor 38E and the output port 38F are of TYPES 8212, 2716, 2114A, 8155, 8085A and 8212, respectively commercially available from the Intel Corporation.

The output port 38F is then connected to an indicator 48 for indicating a car floor.

The ROM 38B has stored therein a deceleration pattern dependent upon each of the distances from the actual car positions to those associated floors at which the elevator car is predetermined to land due to calls registered on the floors or the elevator car and others and is used only to read selectively the deceleration patterns out on the data bus 46. The RAM 38C can write and read the synchronized and advanced floors in and out from the data bus 46. The input port 38A receives the synchronization and advance renewing signals from the renewing switches 34 and 36 and selectively delivers those signals to the central processor 38E, the ROM 38B and RAM 38C.

Figure 4:
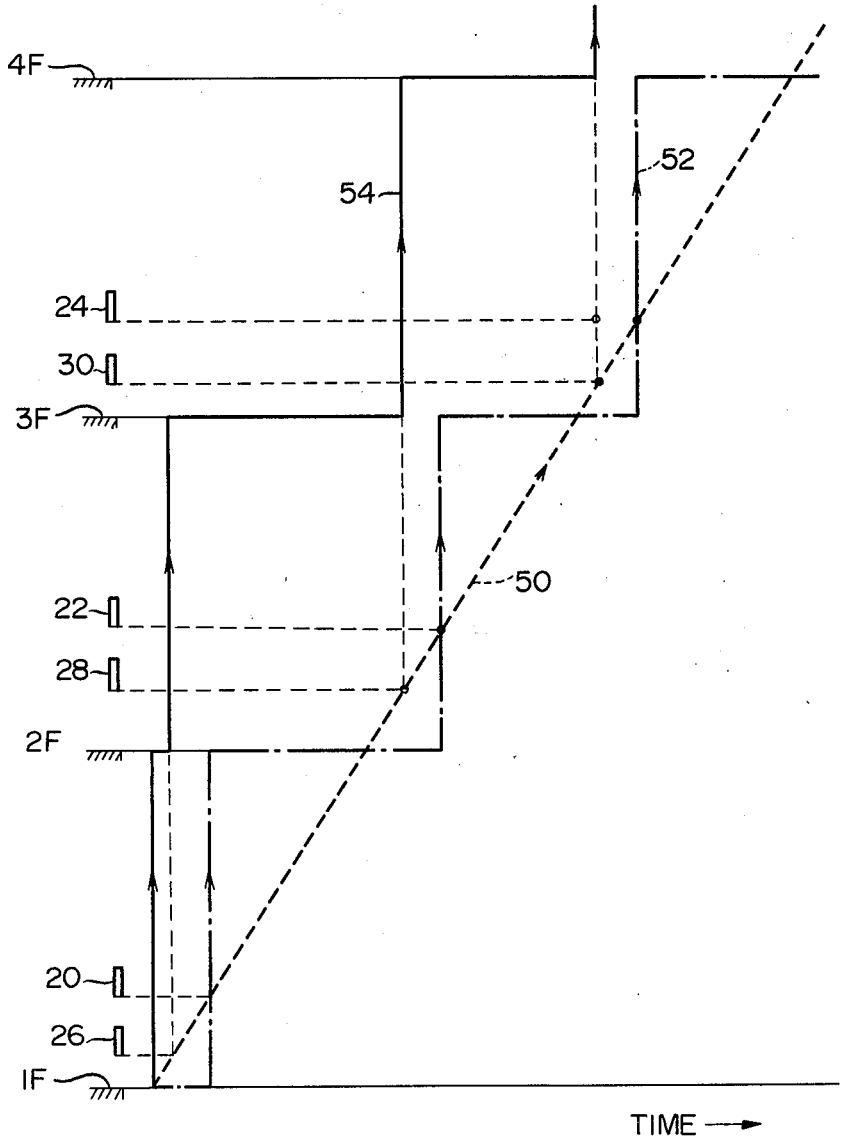
FIG. 4 is a diagram illustrating a traveling path of the elevator car shown in FIG. 2 and loci of a synchronized and advanced floor for the elevator car plotted in the ordinate against time in the abscissa.

The operation of the arrangement shown in FIGS. 2 and 3 will now be described in conjunction with FIG. 4, wherein there are illustrated a traveling path for the elevator car shown in FIG. 2 and loci of a synchronized and an advanced floor developed in the operation of the arrangement shown in FIG. 2. Assuming that the elevator car 32 is located at the first floor 1F, the same has its synchronized and advanced positions lying on the first floor 1F which is preliminarily stored in the RAM 38C. The elevator car 32 is then initiated so as to ascend along an operating line 50 as shown by a dotted line describing the actual car position plotted the ordinate against time the abscissa in FIG. 4. Then, the synchronization renewing switch 34 engages the switch activator 20 to deliver an output to the central processor 38E through the input port 38A. The central processor 38E calculates a synchronized floor as lying on the second floor 2F according to a synchronization calculation program stored in the RAM 38C. That is, the synchronized floor is changed from the first floor 1F to the second floor 2F as shown by the arrowed broken line 52 vertically running between the first and second floors in FIG. 4. The synchronized floor thus calculated is written in the RAM 38C at an address for the synchronized floor and read out therefrom as a synchronized floor.

When the elevator car 32 has passed through the second floor 2F and the switch 34 thereon engages the switch actuator 22, the switch 34 delivers an output to the input port 38A. Then, the central processor 38E effects a similar calculation as described in conjunction with the engagement of the switch 34 with the switch actuator 20, whereby the address for the synchronized floor position is rewritten in the RAM 38C as coinciding with the third floor 3F as shown by the arrowed broken line 52 vertically running between the second and third floors 2F and 3F respectively. Thereafter, the process as described above is repeated with the result that the synchronized floor is changed in a stepped manner as shown by its locus expressed by the stepped broken line 52.

On the other hand, upon the start of the elevator car 32 from the first floor 1F, the advanced floor is calculated as lying on the second floor 2F by the central processor 38E according to an advance calculation program stored in the ROM 38B. The calculated advanced floor is written in the RAM 38C at an address for the advanced floor and sensed as an advanced floor.

When the advance renewing switch 36 on the elevator car 32 engages the switch actuator 26 during this ascent thereof, the same delivers an output to the central processor 38E through the input port 38A. As in the engagement of the switch 34 with the switch actuator 20, the central processor 38E reads out the synchronized floor at that time from the RAM 38C and calculates the advanced floor as the sum of the synchronized floor and two floors (see arrowed solid line vertically running between the second and third floors 2F and 3F respectively and dotted line forming a downward extension thereof). This results in the re-writing of the address for the advanced floor in the RAM 38C. The advanced floor at that time is thereby sensed to lie on the third floor 3F and held at and after that time as shown by the horizontal solid line running on the same level as the third floor 3F.

When the elevator car 32 passes through the second floor 2F and its switch 36 engages the switch actuator 28, the switch 36 delivers an output to the input port 38A. Thereafter, the central processor 38E effects a calculation similar to that described above with the result that the address in the RAM 38C for the advanced floor is rewritten to lie on the fourth floor 4F.

The process as described above is then repeated.

Therefore, it will readily be understood that the advanced floor is changed as shown at stepped solid line 54 describing a locus thereof.

Assuming that, when the advanced floor proceeds to the fourth floor 4F, an up call has been registered on that floor, the advanced floor is held on the fourth floor 4F. Under these circumstances, a hoist motor (not shown) senses separately the actual position of the elevator car 32 from the number of rotations thereof. Then, a deceleration pattern is read out from the ROM 38B corresponding to the distance between the sensed actual car position and the fourth floor 4F. Accordingly, the elevator car 32 is decelerated following the read deceleration pattern while a comfortable ride is maintained until the car 32 lands at the fourth floor 4F.

It is to be noted that, when the elevator car 32 is stopped to deenergize and drop out a travel relay (not shown), the synchronized floor at that time is always written into the RAM 38C at the address for the advanced floor. As described above, the advanced floor is calculated on the basis of the associated synchronized floor. Therefore, the advanced floor is not erroneously determined unless the associated synchronized floor is wrong. Also, even if the elevator car should be suddenly stopped during its travel, the advanced floor is corrected to the associated synchronized floor as in the normal landing of the elevator car as described above. This is because the above-mentioned travel relay (not shown) is deenergized and dropped out.

From the foregoing it will readily be understood that upon the start of the elevator car from any floor other than the first floor, the advanced floor similarly proceeds to that floor located just above the starting floor.

While the present invention has been described in conjunction with the calculation of the advanced floor by which an amount two floors equal to is added to the synchronized floor, it is to be understood that any desired number of the floors may be added to the synchronized floor in accordance with a particular speed of travel of the elevator car.

It will also readily be understood that the process as described above in conjunction with the ascent of the elevator car is equally applicable to the descent thereof. In the latter case it is to be noted that the calculation of the advanced floor is obtained by subtracting a number of floors from the synchronized floor.

Figure 5:
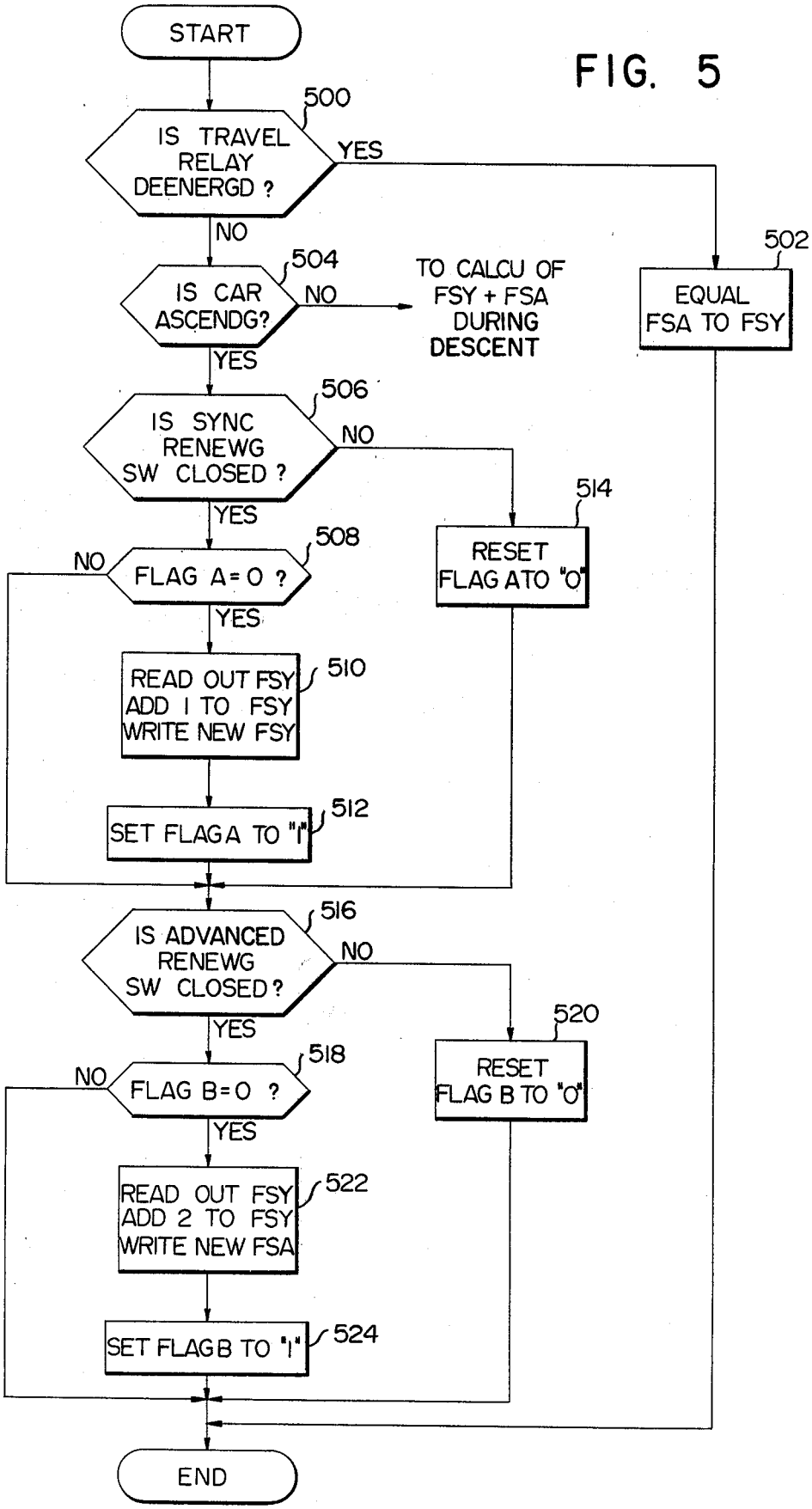
FIG. 5 is a flow chart programming the operation of the arrangement shown in FIGS. 2 and 3.

The operation of the arrangement shown in FIGS. 2 and 3 will now be described in more detail with reference to FIG. 5 wherein there is illustrated a flow chart describing a program for the operation of the arrangement performed by the micro-processor shown in FIG. 3. The program is stored in the ROM 38B and is started in an interrupting manner at predetermined constant time periods by an interrupting period-control timer 38D. Also, another program (not shown) is arranged to execute an initializing process required for an associated elevator control system to rise by the micro-processor.

The program is started in the START step and entered into the step 500 where it is determined if the travel relay (not shown) is in its deenergized state. If the relay is in its deenergized state, as determined in the step 500, then the step 502 is entered where the advanced floor FSA is always maintained so as to coincide with the synchronized floor FSY. If the travel relay is not in its deenergized state, as determined in the step 500, then the step 504 is entered. The step 504 determines if the car is ascending. If so, a program is executed with the calculation of an advanced and a synchronized floor during the ascent of the elevator car.

More specifically, the step 506 determines if the synchronization renewing switch 34 is on its CLOSED position by engaging any one of the switch actuators 20, 22 and 24. If the switch 34 is in its CLOSED position, as determined in the step 506, then the program enters the step 508 where it is determined whether or not a calculation route control flag A is equal to a binary ZERO. If the flag A is not equal to a binary ZERO, as determined in the step 508, the calculation of the synchronized floor is stopped and proceeds to that of the advanced floor as described later.

On the other hand, when the flag A is equal to a binary ZERO as determined in the step 508, the step 510 is entered. In the step 510, the synchronized floor FSY is read out from the RAM 38C at an address destined therefor and added to one (1) after which the sum of the synchronized floor FSY and one is written in the RAM 38C as a new synchronized floor FSY. Then, the flag A is set to a binary ONE in the step 512, whereupon the program for calculating the synchronized floor is completed.

On the other hand, when the step 506 determines that the switch 34 is not in its CLOSED position, the flag A is reset to a binary ZERO, also resulting in the end of the program for calculating the synchronized floor.

It is noted that the calculation route control flag A is also reset to a binary ZERO by the initializing program (not shown) and a program (not shown) executed during the stoppage of the elevator car.

After the completion of the program for calculating the synchronized floor, the program for calculating the advanced floor is started. First, the step 516 determines if the advance renewing switch 36 is in its CLOSED position by engaging any one of the switch actuators 26, 28 and 30. If so, the next succeeding step 518 determines if a calculation route control flag B is equal to a binary ZERO. If the switch 36 is not in its CLOSED position, then the flag B is reset to a binary ZERO in the step 520 after which no process after the step 516 is prevented from processing unless the flag A is again reset to a binary ZERO.

Like the flag A, the flag B is arranged to be also reset to a binary ZERO by the inilializing program (not shown) and the program (not shown) executed during the stoppage of elevator car.

If the flag B is not equal to the binary ZERO, as determined in the step 518, then the step END is reached. On the other hand, when the flag B is equal to the binary ZERO, as determined in the step 518, the synchronized floor FSY is read out from the RAM 38C at the address thereof and added to two (2) in the step 522. In the step 522, the resulting sum is also written into the RAM 38C at an address destined therefor in the step 522 as a new advanced floor. Following this, the flag B is set to a binary ONE in the step 524, whereupon the calculation of the advanced floor is completed. That is, the step END is reached after which the step 524 is prevented from processing unless the flag B is again reset to a binary ZERO.

After the descent of the elevator car has been determined in the step 504, programs for calculating the synchronized and advanced floor during the descent of the elevator car are executed in a series of steps similar to the steps 506 et segg excepting that a subtraction rather than an addition is effected in steps similar to the steps 510 and 522.

From the foregoing it is seen that the present invention provides a floor selector for an elevator system including a first calculation means responsive to the passage of a first switch on an elevator car through each of first switch actuators disposed in an associated hoistway to calculate a synchronized floor through the addition or subtraction of one floor effected by an electronic computer or a micro-processor involved, and a second calculation means responsive to the start of the elevator car or to the passage of a second switch on the car through each of second switch actuators disposed in the hoistway to calculate an advance floor through the addition or subtraction of a predetermined number of the floors, for example, two floors effected by the micro-processor. The synchronized and advanced floors thus calculated are written or entered in an associated RAM at predetermined addresses and used with the next succeeding calculation.

The present invention has several advantages. For example, the present invention provides a floor selector for an elevator system which is high in reliability because it does not rely upon mechanical operation and which is economical. As the advanced floor is calculated on the basis of the associated synchronized floor, the advanced floor is not erroneously calculated unless the synchronized floor is erroneously determined. Also, even upon a sudden stoppage of the elevator car, the advanced floor at the re-start thereof is corrected to coincide with the synchronized floor because an associated travel relay is deenergized. Furthermore, since the advanced floor is arranged to coincide with the synchronized floor upon the stoppage of the elevator car, the elevator can be smoothly operated without the occurrence of an error in the position of the advanced floor relative to the associated synchronized floor.

While the present invention has been illustrated and described in conjunction with a single preferred embodiment thereof, it is to be understood that numerous changes and modifications may be resorted to without departing from the spirit and scope of the present invention.

What is claimed is:

1. A floor selector for an elevator system having an elevator car traveling within a hoistway extending through a plurality of floors disposed at predetermined equal intervals one above another, comprising: means including an electronic computer for sensing successively synchronized floors displayed in synchronization with the travel of said elevator and advanced floors in advance of associated synchronized floors and for delivering signals for said synchronized and advanced floors wherein there are provided a first and a second switch actuator disposed between each pair of adjacent floors within said hoistway; first calculation means responsive to the passage of said elevator car through said first switch actuator so as to calculate the synchronized floor by effecting the addition or subtraction of one floor by means of said electronic computer, and second calculation means responsive to one of either the start of said elevator car or to the passage of said elevator car through said second switch actuator so as to calculate said advanced floor by adding or subtracting a predetermined number of floors to or from said synchronized floors by means of said electronic computer.

2. A floor selector for an elevator system as claimed in claim 1, wherein there is further provided means for causing said advanced floor to coincide with said synchronized floor upon the stoppage of said elevator car.

* * * * *